US006520102B1

(12) United States Patent
Johnson

(10) Patent No.: US 6,520,102 B1
(45) Date of Patent: Feb. 18, 2003

(54) BOATLIFT AND TRANSPORT APPARATUS

(76) Inventor: Richard S. Johnson, 38568 Woodduck La., North Branch, MN (US) 55025

( * ) Notice: Subject to any disclaimer, the term of this patent is extended or adjusted under 35 U.S.C. 154(b) by 0 days.

(21) Appl. No.: 10/033,393

(22) Filed: Dec. 28, 2001

(51) Int. Cl.[7] ..... B63C 7/00
(52) U.S. Cl. ..... 114/44; 405/3
(58) Field of Search ..... 114/44; 405/3

(56) References Cited

U.S. PATENT DOCUMENTS 4,318,632 A * 3/1982 Fortmeyer ..... 280/414.1
5,238,324 A * 8/1993 Dettling, Jr. ..... 405/220
5,562,362 A * 10/1996 Vezner ..... 114/44
5,687,663 A 11/1997 Wahlstrand ..... 114/44

FOREIGN PATENT DOCUMENTS

FR 2645497 A * 10/1990

* cited by examiner

*Primary Examiner*—Jesus D. Sotelo
(74) *Attorney, Agent, or Firm*—Jacobson & Johnson

(57) ABSTRACT

A lift and transport assembly for a boatlift comprising a first axle and a second axle having a wheel located proximate the ends of each axle, at least two axle-supporting cables securely attaching the axles to their respective boatlift attaching site; a first pulley securely attached to the first axle and a second pulley securely attached to the second axle, and an axle rotating cable attaching the first pulley to the second pulley.

29 Claims, 9 Drawing Sheets

BOATLIFT AND TRANSPORT APPARATUS

FIELD OF INVENTION

The present invention relates to boatlifts, and more specifically, to a lift and transport apparatus for the installation and removal of a boatlift from a body of water.

BACKGROUND OF THE INVENTION

The use of a boatlift allow boat owners to remove their boats out of the water when their boats are not in use to protect the boats from damage due to ice that forms on the water surface when the temperature falls below freezing and also to various floating debris, plant life, storms and/or large waves. Most boatlifts have a lower or base portion comprising plates or feet that are submerged under water and a top portion, which supports the boat above the water. Although the plates/feet provide stability to the boatlift during its use in the water, the stability that they provide also results in the difficult task of removing the boatlift from the water onto dry land when so desired.

PRIOR ART

U.S. Pat. No. 5,687,663 discloses a boatlift transport apparatus having one or more floats that are actuated by operation of the boatlift.

SUMMARY OF THE INVENTION

The present invention relates to boatlifts, and more specifically, to a lift and transport assembly for the installation and removal of a boatlift from a body of water. Briefly, the present invention comprises at least one axle having at least one wheel engaging the axle, at least one flexible member securely supporting the axle to a boatlift; a pulley attached to the axle, and an axle-rotating member attached to the pulley.

An advantage of the present invention is that it provides for a portable boatlift transport apparatus and since the present invention attaches to an existing boatlift frame, no housing is required. In addition, the present invention is extendable thus can be used with boat lifts of various sizes.

DESCRIPTION OF THE PREFERRED EMBODIMENT

Figure 1:
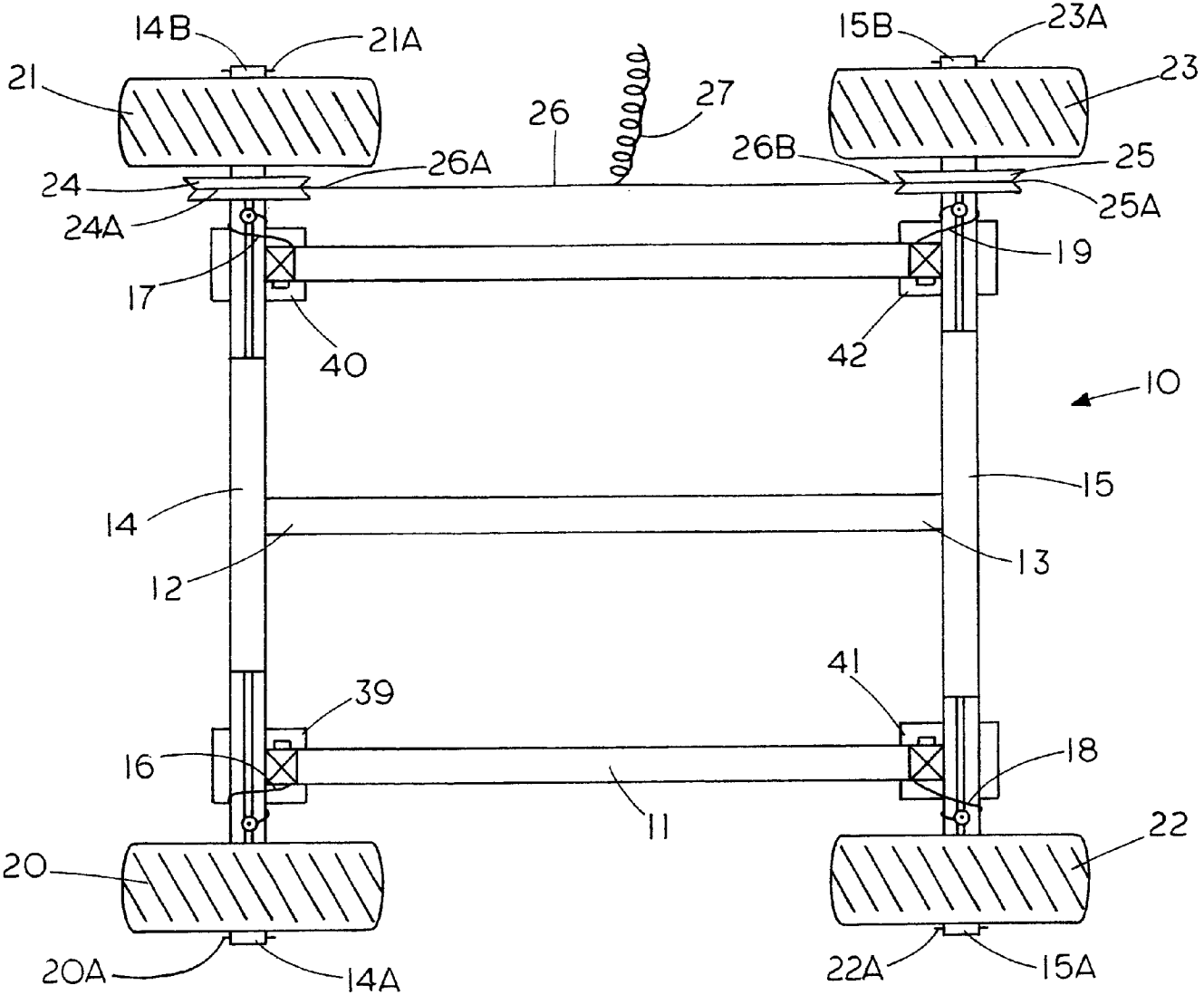
FIG. 1 shows a top view of the preferred embodiment of the present invention secured to a boatlift.

Referring to FIG. 1, reference numeral 10 identifies a boatlift-transporting device. Reference numeral 11 identifies a boatlift frame having a first end 12 and a second end 13. Located at first end 12 of boatlift frame 11 is a first axle 14 having a first end 14A and a second end 14B. Located at the second end 13 of boatlift frame 11 is a second axle 15 having a first end 15A and a second end 15B. Axle 14 is held in position at the first end 12 of boatlift frame 11 by a first flexible member 16 and a second flexible member 17. The flexible members comprises any type of sturdy flexible material such as, but is not limited to, a chain, a rope, a wire, or a web for functionally engaging the axles. Member 16 is shown in FIG. 1 located proximal first end 14A of axle 14 while second member 17 shown located proximal second end 14B of axle 14. Axle 15 is held in position at second end 13 of boatlift frame 11 by a third flexible member 18 and a fourth flexible member 19. Member 18 is shown located proximal first end 15A of axle 15 while fourth flexible member 19 is shown located proximal second end 15A of axle 15.

Rotatably located at the end of each of the axles are wheels 20, 21, 22 and 23. The wheels are held in place by pin sets 20A, 21A, 22A, and 23A. Located between wheel 21 and boatlift frame 11 is a first pulley 24. Pulley 24 is securely attached to axle 14 and has a groove 24*a* for supporting an axle-rotating member. Located between wheel 23 and boatlift frame 11 is a second pulley 25. Second pulley 25 is securely attached to second axle 15 and has a groove 25A for supporting a pulley cable in the same fashion as pulley 24. Connecting pulley 24 to pulley 25 is an axle-rotating member 26 having a first end 26A and a second end 26B. End 26A is attached to pulley 24 with a portion of axle-rotating member 26 wrapped around pulley 24 and engaging groove 24A. End 26B of axle-rotating member 26 is attached to pulley 25 in the same fashion as pulley 24 with a portion of axle-rotating member 26 engaging groove 25A. Axle-rotating member 26 comprises any type of sturdy flexible material such as, but is not limited to, a chain, a rope, a wire, or a web for functionally engaging the pulley. In the example shown, axle-rotating member 26 is engageable to a pulling device, such as a winch, so that a contraction force on axle-rotating member 26 results in a downward displacement of axles 14 and 15 which causes the lifting of boatlift frame 11.

In a boat supporting condition, boatlift frame 11 is supported on a support surface by a base comprising a set of bottom supporting plates 39, 40, 41 and 42 to thereby provide sufficient stability for boatlift frame 11 to support a boat above a body of water. The lifting of boatlift frame 11 in preparation for transport of the boatlift results in the transfer of support of the boatlift frame 11, from bottom supporting plates 39, 40, 41 and 42 to wheels 20, 21, 22, and 23.

Attached to axle-rotating member 26, for providing an indication on the location of axle-rotating member 26 under water, is a member indicator comprising a floatable bungee cord 27. Although the member indicator of FIG. 1 comprises bungee cord 27, other types of floating indicators such as a float may be used.

Figure 2:
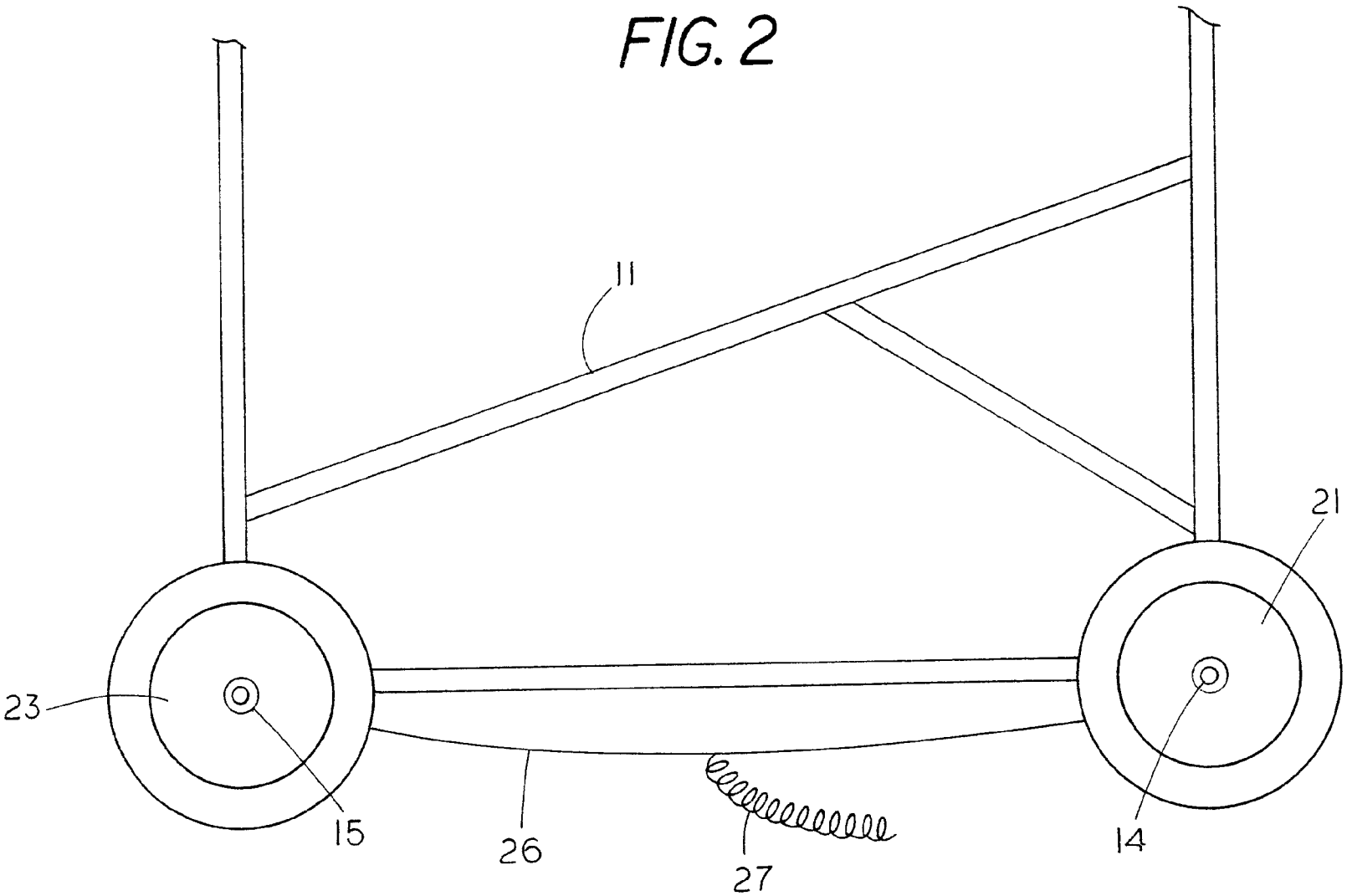
FIG. 2 shows a side view of FIG. 1.

FIG. 2 is a side view of FIG. 1 showing boatlift frame 11 with second wheel 21 and fourth wheel 23 attached thereto. Bungee cord 27 is shown attached to axle-rotating member 26 between first axle 14 and second axle 15.

Figure 3:
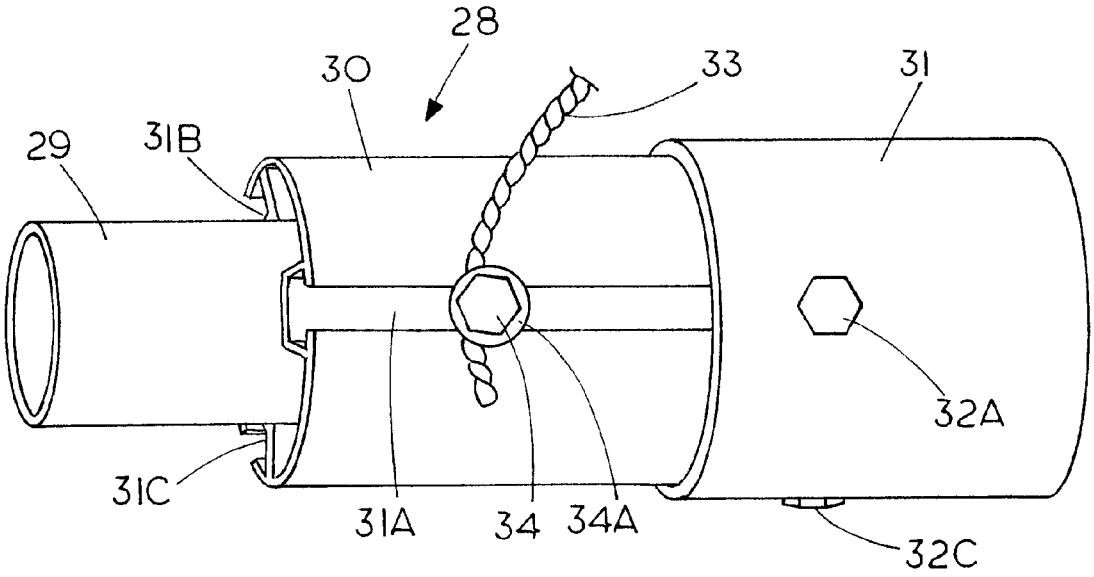
FIG. 3 is a close-up view showing an axle assembly of the present invention.

FIG. 3 shows a close-up of an axle assembly 28 comprising an interior member 29, a shaft 30, and a shaft housing 31. Located on shaft 30 are slots 31A, 31B, 31C designed for engaging various fittings such as the pins or keys 41A, 41B, and 41C of pulley 41 which are shown in FIG. 5. In the assembly of axle 28, interior member 29 is held within shaft 30 by a frictional fit while shaft housing 31 engages the exterior of shaft 30 and is held in position by the use of axle pins 32A, 32B, and 32C (shown in FIGS. 3 and 4). The axle pins comprise bolts, which are threaded through openings located on shaft housing 31 and into the slots of shaft 30 and are held in position by their engagement with a nut (also shown in FIG. 4). The axle pins function to prevent the axial movement of shaft housing 31 during the shaft housing's engagement with shaft 30. Also shown in FIG. 3 is the attachment of an flexible member 33 to shaft 30 by axle pin 34 with the help of a washer 34A to hold member 33 to shaft 30 when axle 28 begins to rotate, causing member 33 to wrap around axle 28.

Figure 4:
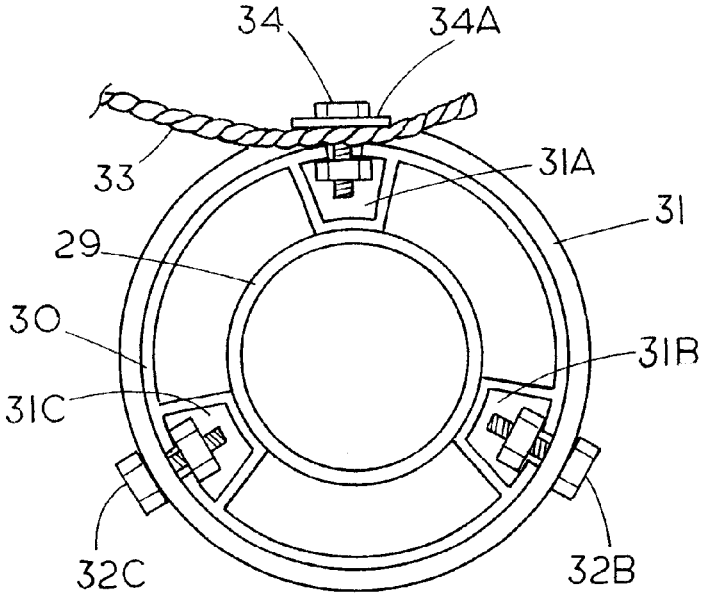
FIG. 4 shows an end view of the axle of FIG. 3.
Figure 5:
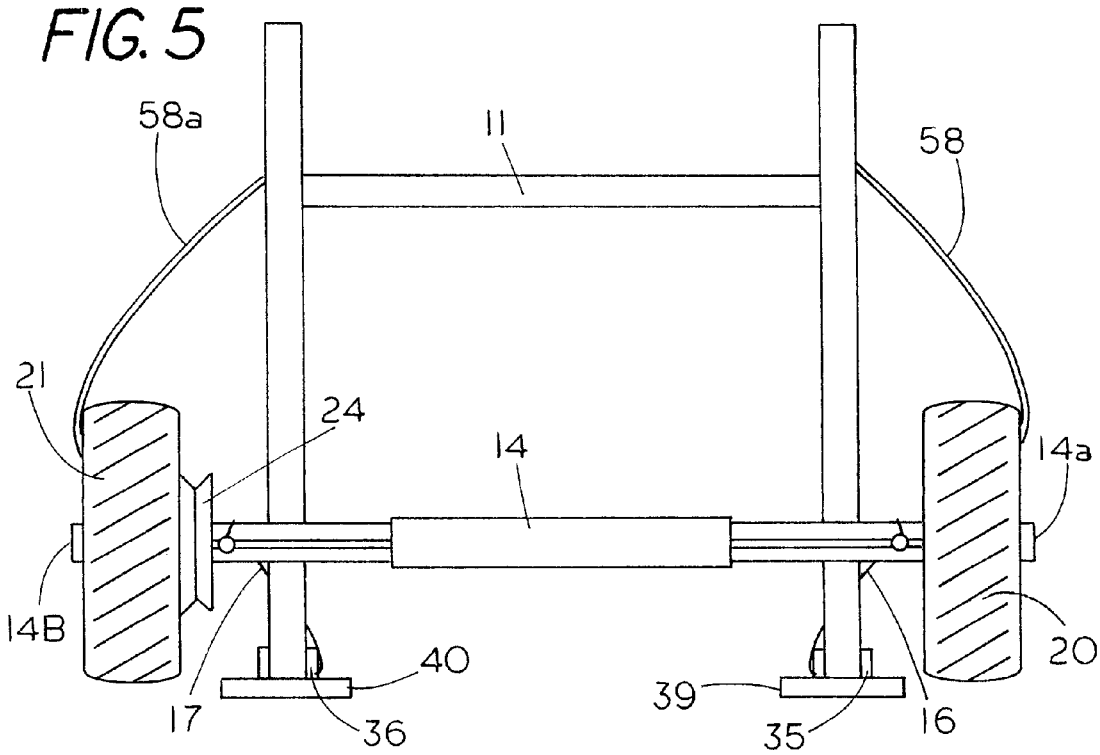
FIG. 5 shows an end view of the boatlift-transporting device of FIG. 1 in an up position.

FIG. 4 is an end view of FIG. 3 showing the engagement of interior member 29, shaft 30 and shaft housing 31. Although shaft 30 of FIG. 4 is shown having three slots (31A, 31B and 31C), the number of slots for a shaft can vary, depending on various factors such as the size of the shaft, the user's preference, and the size of the boatlift.

FIG. 5 is an end view of boatlift-transporting device 10 of FIG. 1 showing axle 14 proximate to boatlift frame 11. As shown, axle 14 is held in position by the attachment of member 16 to axle 14 and a first boatlift attaching site 35 and by the attachment of member 17 to axle 14 and a second boatlift attaching site 36. In their attachment with axle 14, member 16 is attached to axle 14 proximal first end 14A and member 17 is attached to axle 14 proximal second end 14B which generates the centering of axle 14 with respect to the first end 12 of boat lift frame 11. Axle 15 (shown in FIG. 1) is attached to second end 13 of boatlift 11 in a similar fashion.

Figure 6:
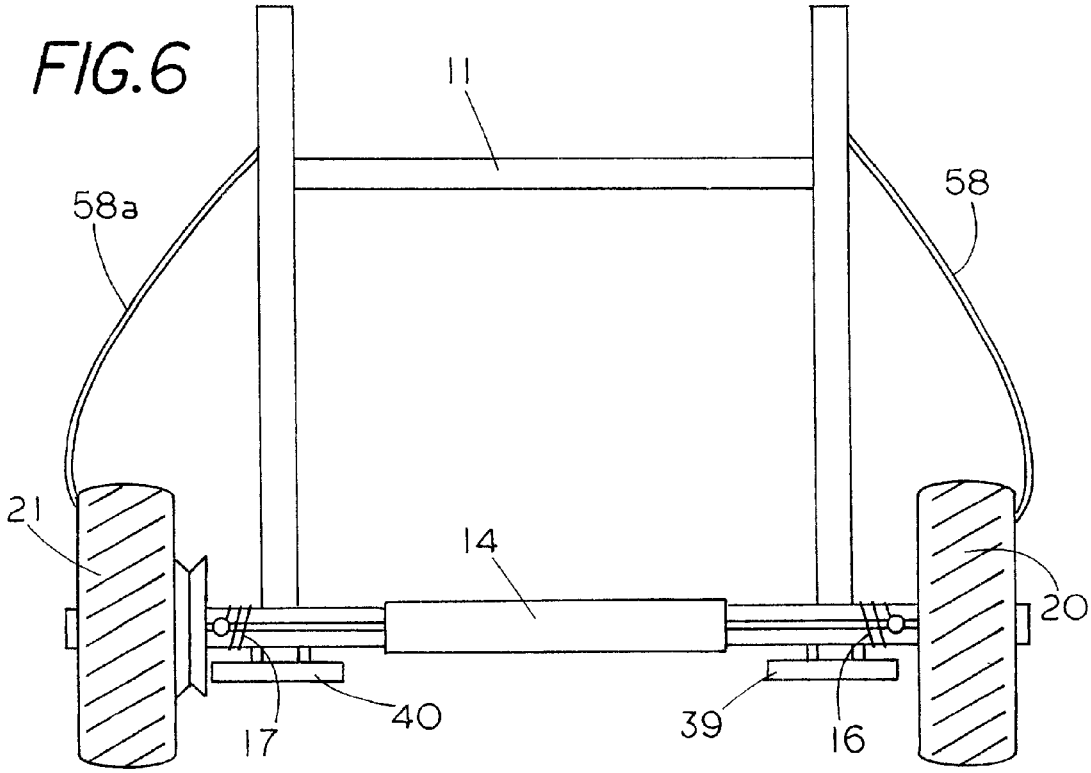
FIG. 6 shows a view similar to FIG. 5 except that the boatlift-transporting device is now in the down position.

Wheel 20 is also shown located proximal end 14A and wheel 21 is shown located proximal end 14B of axle 14. In FIGS. 5 and 6, an air hose 58 is shown attached to wheel 20 at one end and supported on boatlift frame 11 at the other end. A second air hose 58*a* is also shown attached to wheel 21 at one end and supported on boatlift frame 11 at the other end. Air hose 58 and 58*a* allows the user to control the buoyancy of the wheels. Located between wheel 21 and boatlift frame 11 is pulley 24 which is involved in the movement of axle 14.

In FIG. 5, axle 14 is shown in an "up position." The "up position" is defined by boatlift frame 11 supported on a surface by bottom plates 39, 40, 41, and 42 (also refer to FIG. 1). The "up position" is typically when the boatlift is in a boat supporting condition in a body of water since the support of boatlift frame 11 by bottom plates 39, 40, 41, and 42 provides boatlift frame 11 with sufficient stability to support a boat above a body of water.

FIG. 6 is similar to FIG. 5 except that axle 14 is now in the "down position." The "down position" is defined by boatlift 11 supported by wheels 2, 21, 22, and 23 (also refer to FIG. 1). The "down position" results from the rotation of axle 14 from the "up position," which in turn causes members 16 and 17 to wrap around axle 14 to thereby lift bottom plates 39 and 40 vertically closer to axle 14. The weight of boatlift frame 11 prevents axle 14 from being displaced from the end of boatlift frame 11 as axle 14 rotates. As bottom plates 39 and 40 are lifted towards axle 14, bottom plates 39 and 40 relinquishes their support of the boatlift frame 11 and transfers the support to wheels 20 and 21. When boatlift frame 11 is in support by the wheels, boatlift-transporting device 10 becomes sufficiently mobile to allow a user to manually move boatlift-transporting device 10.

Figure 7:
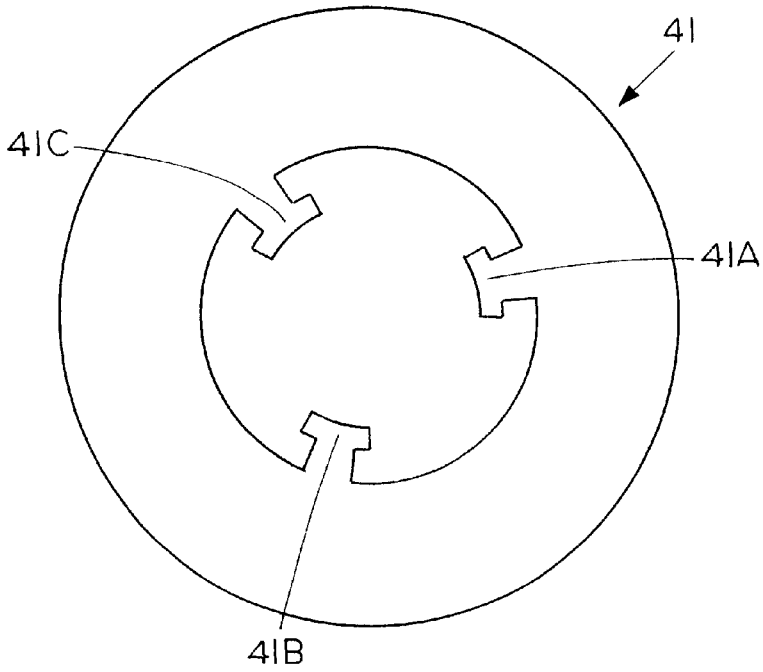
FIG. 7 shows a side view of an axle-engaging pulley.

FIG. 7 shows a side view of an axle-engaging pulley 41. Although the embodiment of pulley 41, as shown in FIG. 7, has a generally circular shape, alternative embodiments of the pulley can come in various shapes. Located at the center of pulley 41 are shaft slot-engaging keys 41A, 41B, and 41C. The keys allow pulley 41 to provide a secured press-fit to the shaft of axles 14 and 15 to thereby generate the simultaneously rotation of the axles with the rotation of pulley 41. Although there are three keys shown in the pulley 41, the number of keys can vary, depending on the user's intended use and preference.

Figure 8:
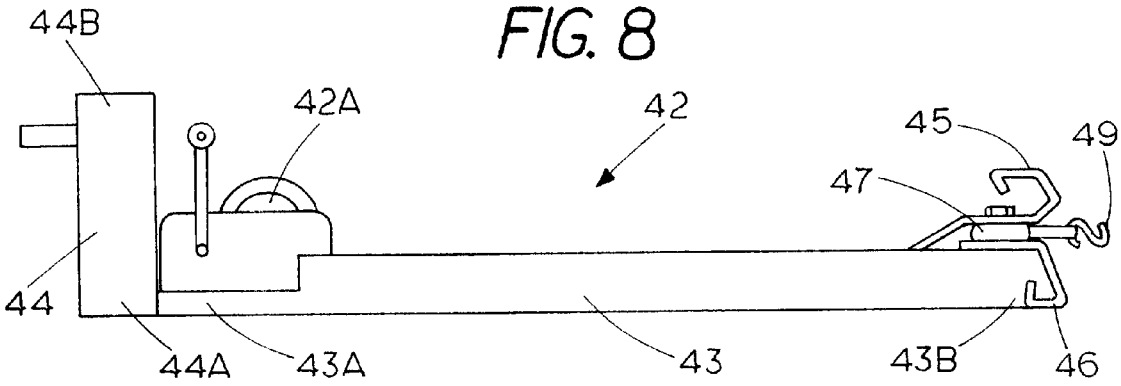
FIG. 8 shows a side view of a winch having an L-shaped body.
Figure 10:
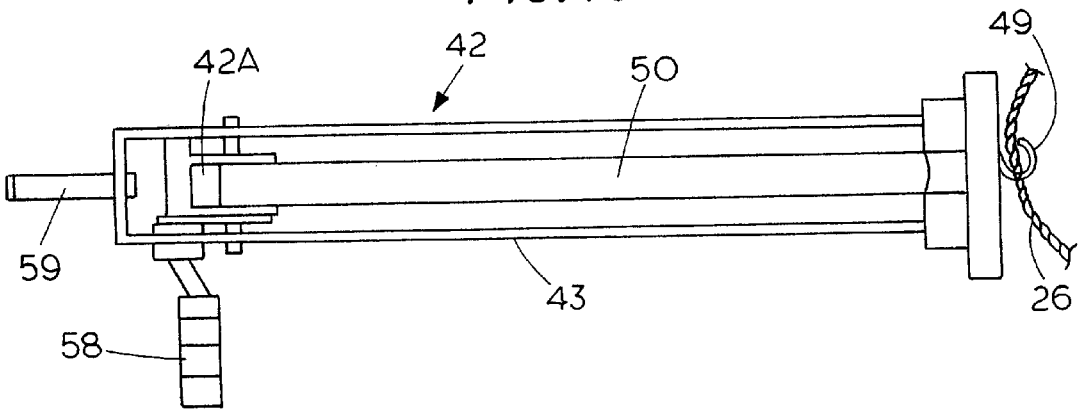
FIG. 10 is a top view of FIG. 8 showing a hook protruding from the first arm of the winch.

FIG. 8 shows a side view of a device, commonly known as a winch 42, used to help lift a boatlift by reducing the force that is required to a boatlift. Winch 42 has a L-shaped body comprising a first arm 43 and a second arm 44, the arms of the winch each having a first end and a second end. First end 43A of arm 43 is securely attached to the first end 44A of arm 44 at a right angle. Located at a second end 43B of arm 43 are a first bar 45 and a second bar 46. Located between bar 45 and bar 46 are winch pulley 47 and winch pulley 48 (pulley 48 is shown in FIG. 10). Located between pulleys 47 and 48 is a hook 49 used for engaging and drawing axle-rotating member 26 into first arm 43 of the winch.

Figure 9:
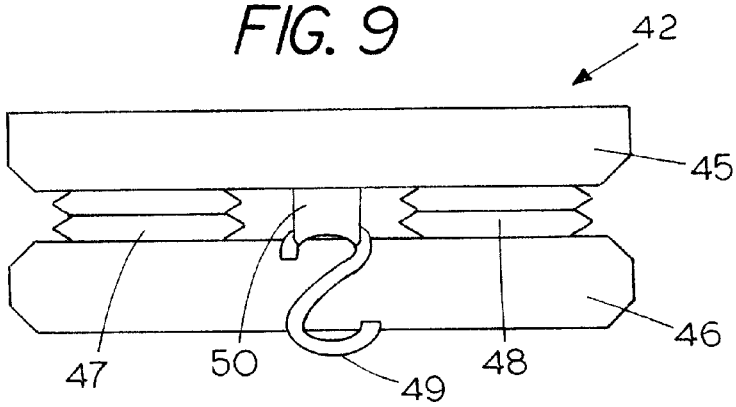
FIG. 9 is a front view showing the winch of FIG. 8.

FIG. 9 is a front view showing winch 42 of FIG. 8. As shown, located between the first bar 45 and the second bar 46 of winch 42 are first winch pulley 47 and second winch pulley 48. Located between the pulleys of winch 42 is an axle-rotating member-engaging hook 49 attached a web 50.

Figure 11:
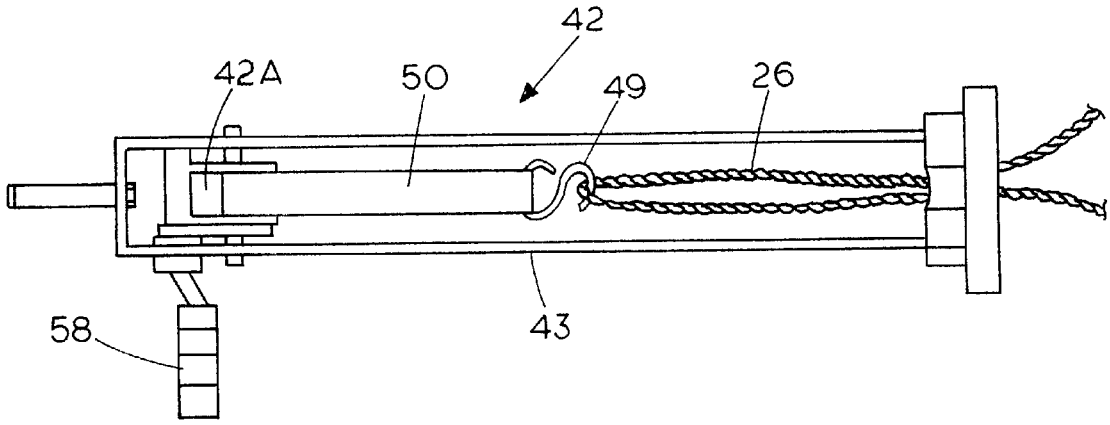
FIG. 11 is a top view of FIG. 8 showing a hook drawing an axle-rotating member into the first arm of the winch.

FIG. 10 and FIG. 11 are both top views of FIG. 8 showing web 50 attached to hook 49. FIG. 10 shows hook 49 protruding from bars 45 and 46 (also refer to FIG. 9) while engaging axle-rotating member 26. FIG. 11 shows hook 49 drawing axle-rotating member 26 into winch 42. To draw axle-rotating member 26 into winch 42 a user uses one hand to grip supporting handle 59 of winch 42 while simultaneously turning cranking handle 58. The turning action of cranking handle 58 draws web 50 to winch axle 42A. As web 50 is drawn back into winch 42, web 50 pulls or draws axle-rotating member 26 into the winch along with it. During this time, a latch (not shown) locks winch axle 42A to prevent web 50 from being drawn the opposite direction. The drawing of axle-rotating member 26 into winch 42 results in the rotation of axles 14 and 15 (referring to FIGS. 1, 5, and 6). The rotation of axles 14 and 15 causes members 16, 17, 18 and 19 to simultaneously wrap around axles 14 and 15, thereby causing bottom-supporting plates 39, 40, 41 and 42 of boatlift frame 11 to move vertically towards the axles.

Figure 12:
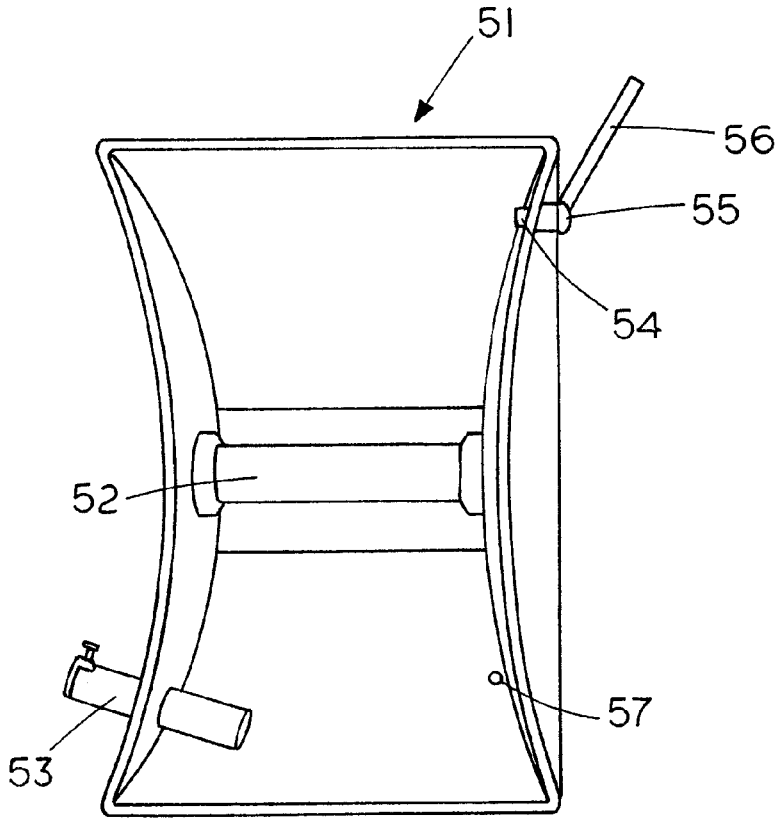
FIG. 12 shows a cut-up view of an alternative embodiment of a wheel that may be used as the wheels for the boatlift-transporting device of the present invention.

FIG. 12 shows a sectional view of an alternative embodiment of a wheel 51 which may be used for boatlift transporting device 10. Located at the center of the wheel is an axle engaging access 52, which allows wheel 51 to be rotatably mounted to the shaft of an axle. Located on the wheel is a water inlet 57, water inlet 57 allowing water to enter wheel 51 to reduce the buoyancy of wheel 51 when the boatlift is in use (wheel 51 being submerged under water supporting boatlift frame 11). Also located on wheel 51 is an air inlet valve 54 having a rotated fitting 55 connectable to an air hose 56 to allow movement of wheel 51 while air hose 56 is attached to wheel 51. Air inlet valve 54 allows air to enter and escape from wheel 51 as water enters wheel 51 by way of water inlet 57 to reducing the buoyancy of wheel 51. Also located on wheel 51 is a water regulator 53 for allowing water to escape from wheel 51.

Figure 13:
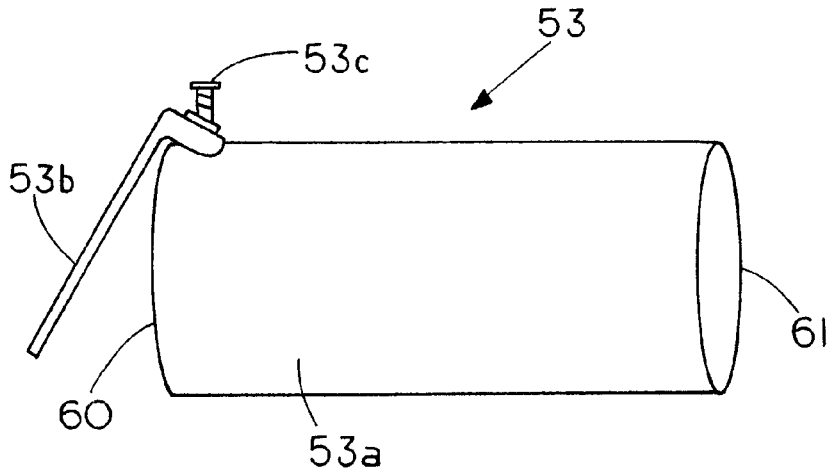
FIG. 13 shows a close-up view of a water outlet regulator.

FIG. 13 shows a close-up view of water outlet regulator 53. Water outlet regulator 53 as shown in FIG. 12 is located on wheel 51, distal to air inlet valve 54. Water outlet regulator 53 comprises a pipe 53*a* having a first end 60 and a second end 61. Connected to first end 60 of pipe 53*a* is a cover 53*b*. Supporting cover 53*b* to first end 60 of pipe 53*a* in a "closed position " (shown in FIG. 12) is a spring loaded pin 53*c*. In the "closed position " cover 53*b* blocks the flow of water through first end 60 of pipe 53*a* thereby preventing water or air from entering or exiting wheel 51. In an "open position" (shown in FIG. 13) cover 53*b* is located at an angle with respect to first end 60 of pipe 53*a,* thereby allowing water and air to flow therethrough.

In its attachment to wheel 51 (as shown in FIG. 12), first end 60 of pipe 53*a* is located on the exterior of wheel 51. When the boatlift-transporting device is in the process of being removed from a body of water, air hose 56 (shown in FIG. 12) allows a user to increase the buoyancy of wheel 51 by introducing pressurized air into wheel 51 by way of air inlet valve 54. As pressurized air is introduced into wheel 51, the pressurized air directs water through pipe 53*a,* pushing the water against cover 53*b*. The force of water pushing against cover 53*b* eventually causes cover 53*b* to move from the "closed position" (shown in FIG. 12) to the "open position" to thereby allow water to escape from wheel 51 thus increasing the buoyancy of wheel 51. When most of the water in wheel 51 has escaped, pressurized air left within wheel 51 will start to escape from wheel 51 through regulator 53, resulting in the formation of bubble on the water surface. The formation of the bubble on the water surface signals to the user to cut off the flow of pressurized air to wheel 51. Once the flow of pressurized air is cut off, cover 53*b* returns to the "closed condition," blocking air within wheel 51 from further escaping while simultaneously preventing water from entering into wheel 51.

Water outlet regulator 53 also allows the flushing of residues such as dirt, mud and small pebbles out of the interior of the wheel by the attachment of a garden hose to water inlet 53 and spraying water into the interior of wheel 51.

Figure 14:
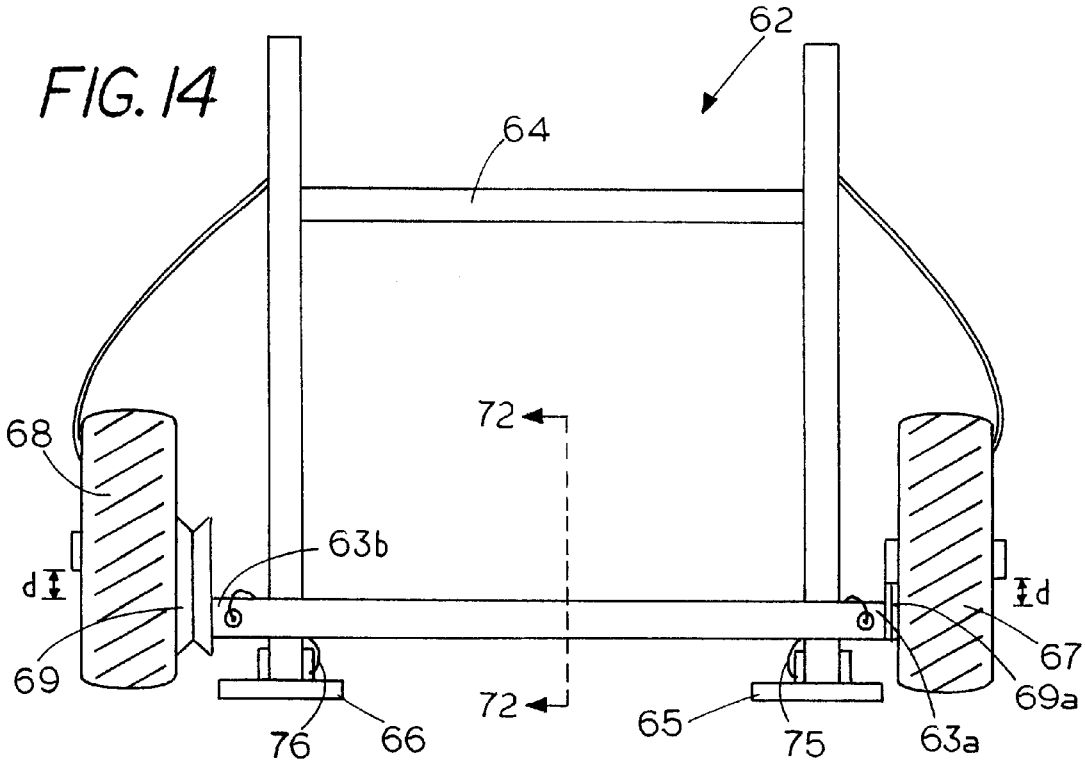
FIG. 14 shows an end view of an alternative embodiment of a boatlift-transporting device in an up position.
Figure 15:
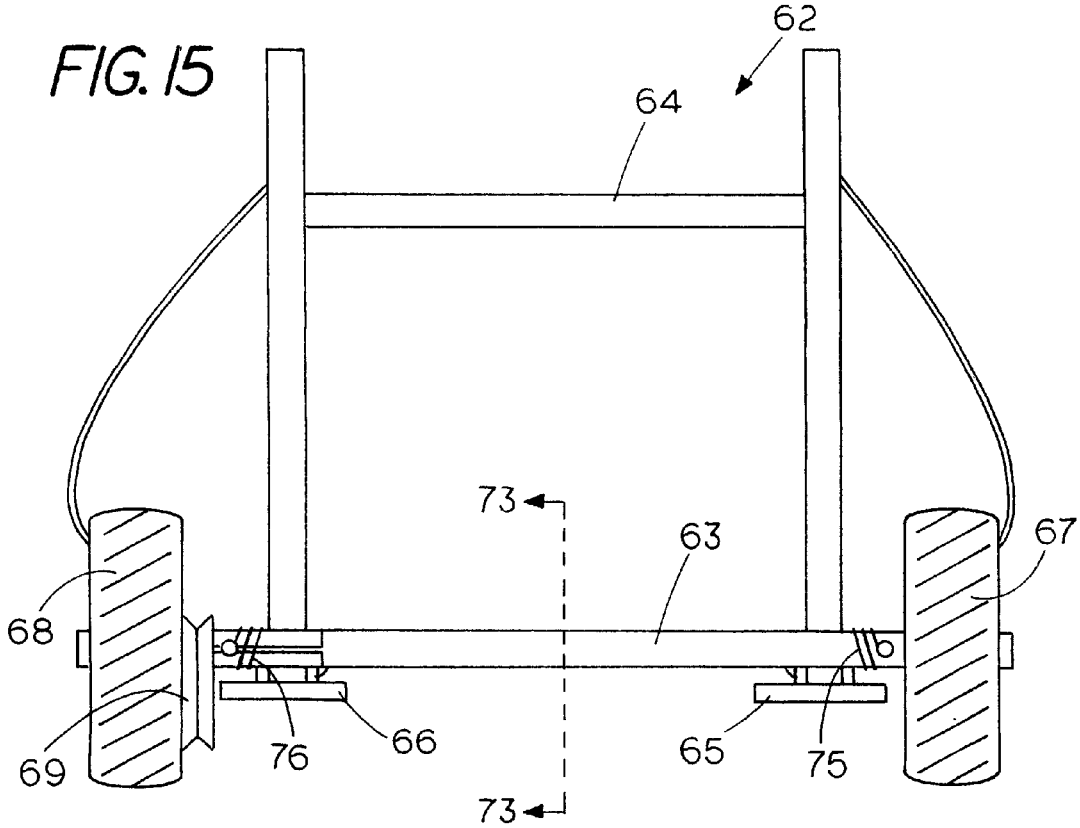
FIG. 15 shows an end view of the boatlift-transporting device of FIG. 14 in a down position.

FIGS. 14 and 15 show an end view of an alternative boatlift-transporting device 62. Boatlift-transporting device 62 is similar to the device of FIGS. 5 and 6 but in the embodiment of FIGS. 14 and 15, first end 63*a* of axle 63 is attached to wheel 67 at an offset distance "d" from an axis of rotation of wheel 67 by way of an extension 69*a*. The second end 63*b* of axle 63 is attached to wheel 68 by way of an extension comprising a lever arm 69 allowing for axle 63 to rotate with lever arm 69. Second end 63*b* is attached to lever arm 69 at an offset distance "d" from an axis of rotation of wheel 68. In the present embodiment lever arm 69 comprises a quarter circle configuration.

In FIG. 14, boatlift-transporting device 62 is shown in an "up position." The "up position" is defined by the support of boatlift frame 64 on a surface by bottom plates 65 and 66. In the "up position" axle 63 extends downwardly to thereby provide more underwater clearance area for a boat to enter boatlift-transporting device 62. Providing more underwater clearance area further reduces the possibility of a boat bottom striking against axle 63 during the boat's entrance into boatlift-transporting device 62 and damaging the boat, the axle or both.

FIG. 15 is similar to FIG. 14 except that boatlift-transporting device 62 is shown in a "down position." The "down position" is defined by the support of boatlift 62 by wheels 67 and 68. As shown in FIG. 15, it is preferred that axle 63 is raised higher in the "down position" than in the "up position" to increase the surface clearance of boatlift-transporting device 62.

Figure 16:
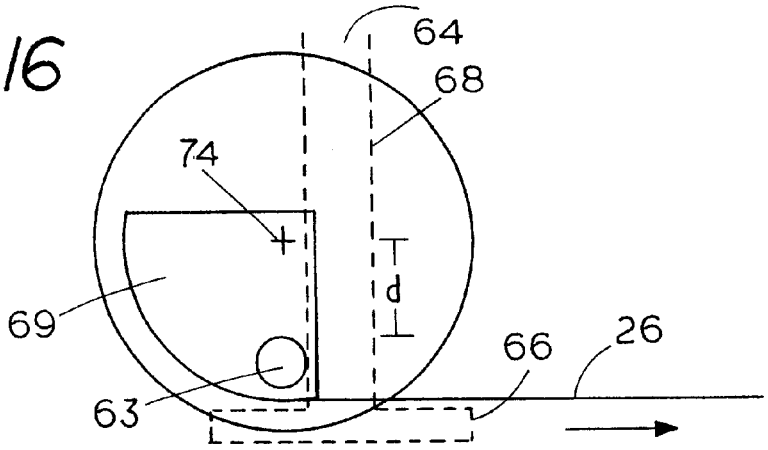
FIG. 16 is a cross-sectional view of FIG. 14 taken along lines 16—16.

FIG. 16 is a cross-sectional view taken along the line 16—16 of FIG. 14 showing the positioning of boatlift frame 64 and bottom plate 66 with respect to wheel 68, lever arm 69 and axle 63 in the "up position." In the "up position" axle 63 is located at a vertical distance "d" from a center axis of rotation 74 of wheel 68. As shown by the dotted lines, boatlift frame 64 in FIG. 16, is supported on a surface by bottom plate 66.

Figure 16A:
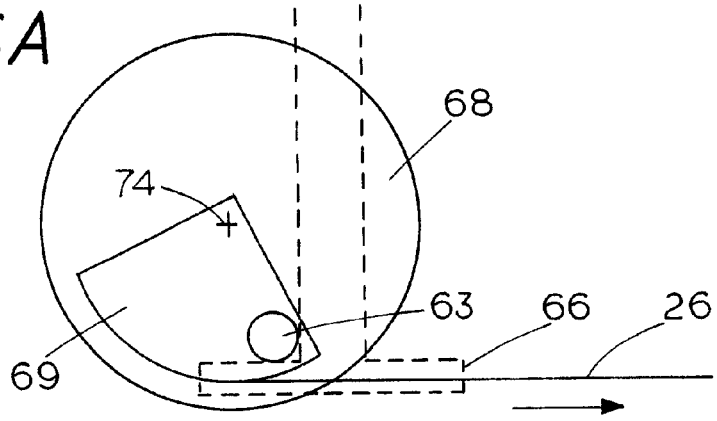
FIG. 16A is a cross-sectional view of a boatlift-transporting device of FIG. 16 in the process of moving from an up position to a down position.

FIG. 16A shows the rotation of lever arm 69 caused by the pull force of axle-rotating member 26. As shown, the pull force of axle-rotating member 26 causes lever arm 69 to rotate, which in turn causes the rotation of axle 63. The rotation of axle 63 in turn causes cables 75 and 76, as shown in FIG. 15, to wrap around axle 63 to thereby help lever arm 69 lift bottom plate 66 vertically closer to axle 63. As bottom plate 66 is lifted closer to axle 63, bottom plate 66 relinquishes its support of the boatlift frame 64 and transfers the support to wheel 68. During the movement of axle 63 from the "up position" to the "down position" the weight of boatlift frame 64 prevents axle 63 from being displaced from the end of boatlift frame 64 as axle 63 rotates.

Figure 16B:
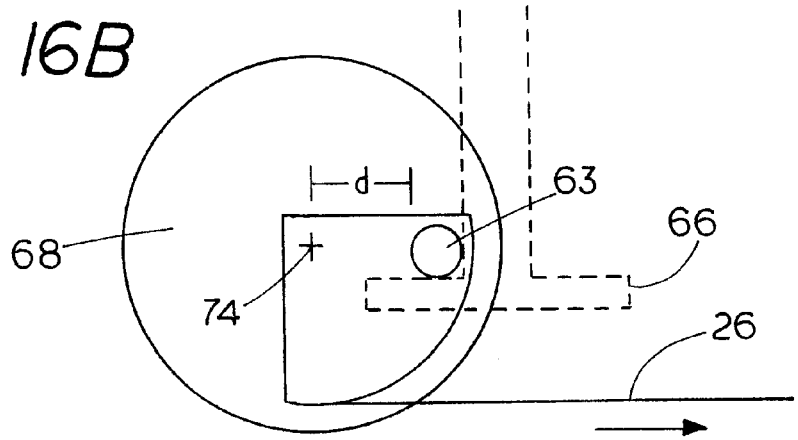
FIG. 16B is a cross-sectional view of FIG. 15 taken along lines 16B—16B.

FIG. 16B is a cross-sectional view taken along the line 16B—16B of FIG. 15 showing the positioning of boatlift frame 64 and bottom plate 66 with respect to wheel 68, lever arm 69 and axle 63 in the "down position." The "down position" results from a complete quarter rotation of lever arm 69 from the "up position" to the "down position" moving axle 63 from the vertical distance "d" from the central axis 74 to the horizontal distance "d" from the central axis 74.

The present invention also includes a method of removing a boatlift frame 11 from a body of water comprising 1. raising a boatlift frame 11 on o at least one wheel; 2. removing boatlift frame 11 from a body of water; 3. rolling the boatlift frame 11 on shore; and 4. lowering the boatlift frame 11 down onto a solid support surface off the wheel; by the use of a device such as a winch 42.

The above method also may include the step of 5. pressurizing at least one wheel with compressed air through the air inlet valve 54 when the wheel is still under water to thereby force existing water out of the wheel by way of the water outlet regulator 53 to make the wheel buoyant. The above method may also include the steps of 6. rotating at least one wheel to allow air inlet valve 54 to be positioned at the top portion of the wheel 51; and 7. pressurizing the wheel to remove any water or residue that may be in the wheel 51.

Although the axle of the present invention shows use of two wheels, one wheel may also be used to support the boatlift. This can be accomplished for example, if the wheel were centered between the first end and the second end of the axle. To provide stability, a wheel having a width sufficiently wide for supporting the device may be used.

In addition, alternative embodiment of the invention may comprise the use of an uneven number of wheels for each axle. For example, a device may include two axles with the first axle having two wheels located proximate its ends while the second axle have one wheel centered between the ends of the second axle to thereby form a tricycle-like wheel configuration. In such a configuration the wheel on the second axle may optionally be used to steer the device as the device is transported on a support surface.

Finally, further embodiments of the invention may comprise the use of more than two wheels on the axles, depending on the user's desired stability.

I claim:

1. An assembly for lifting a boatlift comprising:

a. an axle, said axle having a first end and a second end;

b. a wheel, said wheel attached to said axle to support said axle;

c. a flexible member, said flexible member having a first end secured to said axle and a second end; and d. an axle-rotating member for rotating said axle whereby rotation of said axle wraps said flexible member around said axle to displace a boatlift frame attached to said second end relative to said axle.

2. The assembly of claim 1 including a floating indicator attached to said axle-rotating member for indicating the location of the axle-rotating member under water.

3. The assembly of claim 1 wherein the axle is axially adjustable to fit boatlifts of varying sizes.

4. The assembly of claim 1 including a second axle, said second axle having a first end and a second end, said second axle attached proximate an end of the boatlift frame distal to the first axle by at least one flexible member.

5. The assembly of claim 4 wherein at least one wheel is attached proximate the ends of each axle.

6. The assembly of claim 5 wherein each of said axles comprise:

a. an interior member;

b. a shaft, said shaft having at least one slot; and c. a shaft housing.

7. The assembly of claim 6 including a first pulley attached to the first axle, said pulley having a rotating member-supporting groove.

8. The assembly of claim 7 wherein a first end of said axle-rotating member is secured to said first pulley.

9. The assembly of claim 8 including a second pulley attached to the second axle, said second pulley having a rotating member-supporting groove.

10. The assembly of claim 9 wherein a second end of said axle-rotating member is secured to said second pulley.

11. The assembly of claim 10 wherein the first pulley and the second pulley each includes at least one shaft slot-engaging key to securely attach the pulleys to the shaft.

12. The assembly of claim 1 including a winch for lifting said boatlift frame.

13. The assembly of claim 12 wherein the winch comprises:

a. a first arm and a second arm, said arms having a first end and a second end, the first end of the first arm securely attached to the first end of the second of arm at a right angle;

b. a first winch pulley and a second winch pulley, said winch pulleys located proximal the second end of the first arm between a first bar and a second bar;

c. a handle for gripping said winch, said handle located on the second arm;

d. a crank handle;

e. a web; and f. a hook.

14. An apparatus for lifting a boatlift comprising:

a. a first axle and a second axle, each of said axles having a first end and a second end;

b. at least two flexible members, said flexible members supporting the axles to a boatlift frame;

c a first pulley and a second pulley, said first pulley securely attached to the first axle, said second pulley securely attached to the second axle;

d. at least one wheel attached to each of the axles proximate their ends; and e. an axle-rotating member, said axle-rotating member engageable to a lifting device for lifting said boatlift frame, said axle-rotating member having a first end and a second end, the first end of said axle-rotating member secured to the first pulley and the second end of said axle-rotating member secured to the second pulley whereby a pull force directed on said axle-rotating member results in the rotation of said pulleys and said axles allowing for the movement of the boatlift from a boat supporting condition to a boatlift transporting condition.

15. The apparatus of claim 14 wherein the axles comprise:

a. an interior member;

b. a shaft, said shaft having at least one slot; and c. a shaft housing, the assembly of the interior member, the shaft, and the shaft housing allows each of the axle to be axially adjustable to fit boatlifts of varying sizes.

16. The apparatus of claim 15 wherein at least one flexible member attaches the first axle to a first end of the boatlift and at least one flexible member attaches the second axle to a second end of the boatlift proximate the first ends of the axles and at least one flexible member attaches the first axle to the first end of the boatlift and at least one flexible member attaches the second axle to the second end of the boatlift proximate the second ends of the axles to thereby allow for the centering of the axles with respect to the ends of the boatlift that the axles are attached to.

17. The apparatus of claim 15 wherein said first pulley and said second pulley each includes at least one shaft slot-engaging key.

18. The apparatus of claim 15 including a winch for lifting said boatlift frame.

19. The apparatus of claim 18 wherein the winch is an L-shaped winch comprising:

a. a handle for grapping said winch;

b. a first winch pulley and a second winch pulley, said winch pulleys located proximate the second end of said first arm between the first bar and the second bar;

c. a web; and d. a hook.

20. The apparatus of claim 15 wherein the wheels comprises:

a. an axle-engaging access located at the center of the wheel, said axle-engaging access allowing the wheel to freely rotate there on;

b. a water inlet, said water inlet allowing water to enter the wheel to reduce the buoyancy of said wheel when the boatlift is in use;

c. an air inlet valve, said air inlet valve having a rotatable fitting connectable to an air hose to allow movement of the wheel while the air hose is attached to the wheel, said air inlet valve allowing air to escape from the wheel as water enters the wheel by way of the water inlet to reduce wheel buoyancy; and d. a water outlet regulator comprising a pipe having a cover attached to an end of said pipe by a spring-loaded pin, said water outlet regulator located distal to the air inlet-valve, said water outlet regulator allowing water to escape from the interior of the wheel, said water outlet regulator also allowing residues such as dirt, mud and small pebbles to be flushed out from the interior of the wheel by the attachment of a hose to the water inlet and spraying water into the interior of the wheel.

21. The apparatus of claim 15 wherein the first end of the axles are attached to the corresponding wheels by the pulleys.

22. The apparatus of claim 17 including a floating indicator attached to the axle-rotating member for indicating the location of the axle-rotating member under water.

23. The apparatus of claim 21 wherein said pulleys comprise a lever arm.

24. The apparatus of claim 23 including a first extension attaching the second end of the first axle to at least one wheel and a second extension attaching the second end of the second axle to at least one wheel.

25. The apparatus of claim 24 wherein the first end of said axles are attached to the arm levers at an offset distance from an axis of rotation of their corresponding wheels and the second end of the axles are attached to the extensions at an offset distance from the axis of rotation of their corresponding wheels.

26. A method of removing a boatlift from a body of water comprising:

a. placing an axle having a wheel thereon proximate a boatlift frame;

b. securing the axle to the boatlift frame;

c. rotating the axle to raise the boatlift frame relative to the axle; and d. rolling the boatlift to a remote location while the axle supports the boatlift frame.

27. The method of claim 26 including the step of raising and lowering the boatlift frame by use of a winch.

28. The method of claim 26 including the step of pressurizing at least one wheel underwater with compressed air through an air inlet valve to thereby force water out of the wheel by way of the water outlet regulator thereby making the wheel buoyant.

29. The method of claim 28 including the steps of:

a. rotating the wheel on land to allow the air inlet value to be located at the top portion of the wheel; and b. pressurizing the wheel to remove any water or residue which may be in the wheel.

* * * * *